US008188664B1

(12) United States Patent
Boroczki et al.

(10) Patent No.: US 8,188,664 B1
(45) Date of Patent: May 29, 2012

(54) COMPACT HIGH INTENSITY DISCHARGE LAMP WITH TEXTURED OUTER ENVELOPE

(75) Inventors: Agoston Boroczki, Budapest (HU); Csaba Horvath, Budapest (HU); Istvan Kapas, Budapest (HU)

(73) Assignee: General Electric Company, Schenectady, NY (US)

( * ) Notice: Subject to any disclaimer, the term of this patent is extended or adjusted under 35 U.S.C. 154(b) by 14 days.

(21) Appl. No.: 12/947,163

(22) Filed: Nov. 16, 2010

(51) Int. Cl.
*H01J 17/16* (2006.01)

(52) U.S. Cl. ..... 313/634; 313/493

(58) Field of Classification Search ..... 313/634, 313/493

See application file for complete search history.

(56) References Cited

U.S. PATENT DOCUMENTS

2006/0145624 A1 7/2006 Muckel et al.

FOREIGN PATENT DOCUMENTS

DE 198 34 401 A1 7/1998
WO WO 2004/017359 A2 2/2004

*Primary Examiner* — Vip Patel
(74) *Attorney, Agent, or Firm* — Fay Sharpe LLP

(57) ABSTRACT

A compact mercury-free high intensity discharge (HID) lamp particularly suitable for automotive headlamp application has a pair of spaced and opposing electrodes sealed in a transparent enclosure defining an arc chamber. An outer transparent envelope has a first and second textured light scattering stripe on its interior surface on substantially opposite sides thereof extending continuously from one electrode to the other. The stripes widen the cross-sectional luminance distribution of the arc discharge image and make the image of the arc straighter while keeping light scattering losses at minimum so that the reduced arc peak luminance is still at the desired level. In other versions, a plurality of textured light scattering stripes of smaller widths are employed to replace a single wider light scattering stripe.

20 Claims, 6 Drawing Sheets

COMPACT HIGH INTENSITY DISCHARGE LAMP WITH TEXTURED OUTER ENVELOPE

BACKGROUND OF THE DISCLOSURE

The present disclosure relates to compact mercury-free high intensity discharge (HID) lamps and particularly compact HID lamps intended for automotive headlamp applications. Heretofore, high intensity discharge lamps for general lighting, and likewise, HID lamps for automotive headlamp applications have employed mercury for providing a desired lamp voltage and luminous flux of the lamp, as well as spatial luminance distribution of the emitting discharge arc volume and spectral power density distribution of the emitted light. In case of automotive applications, adequate spatial distribution of arc luminance (in a simplified approach, arc width, arc bending and arc length) is one of the most important characteristics for providing the required forward road illumination from the headlamp of a car during nighttime vehicle operation.

However, it has been desired to eliminate the use of mercury in the manufacture of such discharge lamps to minimize the risks of exposure to toxic materials during manufacturing and to prevent unwanted distribution of these toxic materials during disposal of these lamps upon removal from service or in case of accidental spill of toxic materials in the event of an accident.

Heretofore, there have been several attempts to replace mercury in high intensity discharge lamps. The basic initial and through life optical characteristics of contemporary mercury-free HID lamps are approaching that of their mercury containing counterparts'; however, not all of these technical requirements can fully be satisfied. As an example, mercury-free high intensity discharge lamps have been found to exhibit a discharge arc having a thinner and more curved arc shape geometry than the arc present in mercury-filled high intensity discharge lamps.

In addition, the profile of the arc luminance distribution of a mercury-free discharge arc along the length of the arc between the spaced and opposing electrodes in the discharge chamber still contains "focal spots" or localized regions of higher intensity in the region adjacent the electrodes. An example for the axial arc centerline temperature distribution of a mercury-free high intensity discharge arc is shown in FIG. 5; wherein it is seen that the central region of the arc reaches temperatures of about 5000-6000 K, whereas the regions at the ends of the arc, i.e. adjacent the electrodes, it spikes to reach temperatures of 7000-8000 K.

It has thus been desired to provide a way or means of leveling out both the lateral and axial spatial luminance distribution of the discharge arc in a mercury-free discharge lamp. A "homogenized" arc luminance distribution from a such mercury-free HID lamp would significantly simplify the optical system required to distribute the light rays from the arc into a focused beam, either by the use of mirror reflectors or lenses.

Referring to FIG. 1, the area of desired illumination of the road surface for automotive headlamp applications is shown for "low beam" or "passing beam" illumination mode. This type of road illumination has a sharp light-to-dark transition, or "cut-off line" along a horizontal line in the direction of the opposing lane (line A) and another "cut-off line" along a line tilted upwards by an amount of about 15° in the direction of the travelling vehicle lane (line B). Referring to FIG. 2, the typical illumination levels of the mercury-free arc discharge headlamps from the travelling vehicle is shown for "low beam" mode headlamp operation with the darkest region indicating the area of greatest illuminance. FIG. 3 shows the typical distribution of illumination for a desired "high beam" or "driving beam" headlamp operation mode of a travelling vehicle with the greatest illuminance shown in the darkest shading.

As mentioned above, it has been desired to compensate for the increased curvature and thinness of a mercury-free discharge arc in order to provide a desired arc image spatial luminance distribution constituted by the optical rays emanating from the arc in a manner which is easy to incorporate into the manufacture of the high intensity arc discharge lamp without significantly increasing the cost of the lamp.

SUMMARY OF THE DISCLOSURE

The present disclosure describes a compact high intensity mercury-free arc discharge lamp and particularly such a lamp that is suitable for automotive headlamp application which employs a first textured light scattering strip or stripe on the interior surface of the outer envelope or outer bulb on one side and a second textured light scattering stripe on the substantially opposite side of the outer envelope, each of which stripe extends from one electrode to the opposite electrode of the discharge vessel. The textured light scattering stripes are continuous along the arc length and are substantially in parallel with the arc discharge to make the spatial luminance distribution of the arc more uniform in its transverse cross-section, that is, to make the arc discharge image straighter and wider. At the same time, the textured light scattering stripes reduce the arc luminance inhomogeneity effect from the higher temperature regions (sometimes referred to as "focal spots") of the arc adjacent the electrodes.

In one version, a first and second stripe are formed as a textured surface on the interior surface of the outer envelope, each on substantially opposite sides of the outer envelope; and, in other versions, two plurality or set of stripes are formed a desired spacing apart (substantially on opposite sides of the outer envelope) may be provided.

The mercury-free high intensity discharge lamp of the present disclosure with the textured light scattering stripe extending continuously between the electrodes and running substantially in parallel with the arc discharge along the longitudinal axis of the discharge vessel has the stripe having a width in the range of about 0.5 to 15% of the maximum transverse dimension of the outer envelope.

The mercury-free HID arc discharge lamp of the present disclosure modifies the cross-sectional luminance distribution of the arc discharge image to have a width S defined as the distance between 20% points of peak luminance of the cross-sectional luminance distribution function of the arc discharge image in the range of about 0.7 to 1.5 mm. As an additional advantage, the mercury-free HID lamp of the present disclosure reduces the extent of bending of the arc discharge image measured at substantially half-way between the two opposing electrodes in the discharge chamber by an amount in the range of about 10 to 30% as compared to the extent of bending of the arc image in a lamp without the textured light scattering stripe on the outer envelope.

The HID lamp of the present disclosure in one version provides a stripe which keeps the degree of light scattering under control so that the peak luminance of the cross-sectional arc discharge image to be not less than about 30 Mega candela/$m^2$; and, in another version, to be not less than about 50 Mega candela/$m^2$. In the present practice of the disclosure, the light scattering losses of one version are limited to be less than about 5%; and, in another version, to be less than about 3%.

The textured striping on the interior of the outer envelope of the present mercury-free high intensity discharge lamp thus minimizes arc curvature, widens and more evenly distributes luminance of the arc image to facilitate directing and focusing a beam for headlamp applications.

DETAILED DESCRIPTION OF THE PREFERRED EMBODIMENTS

Figure 1:
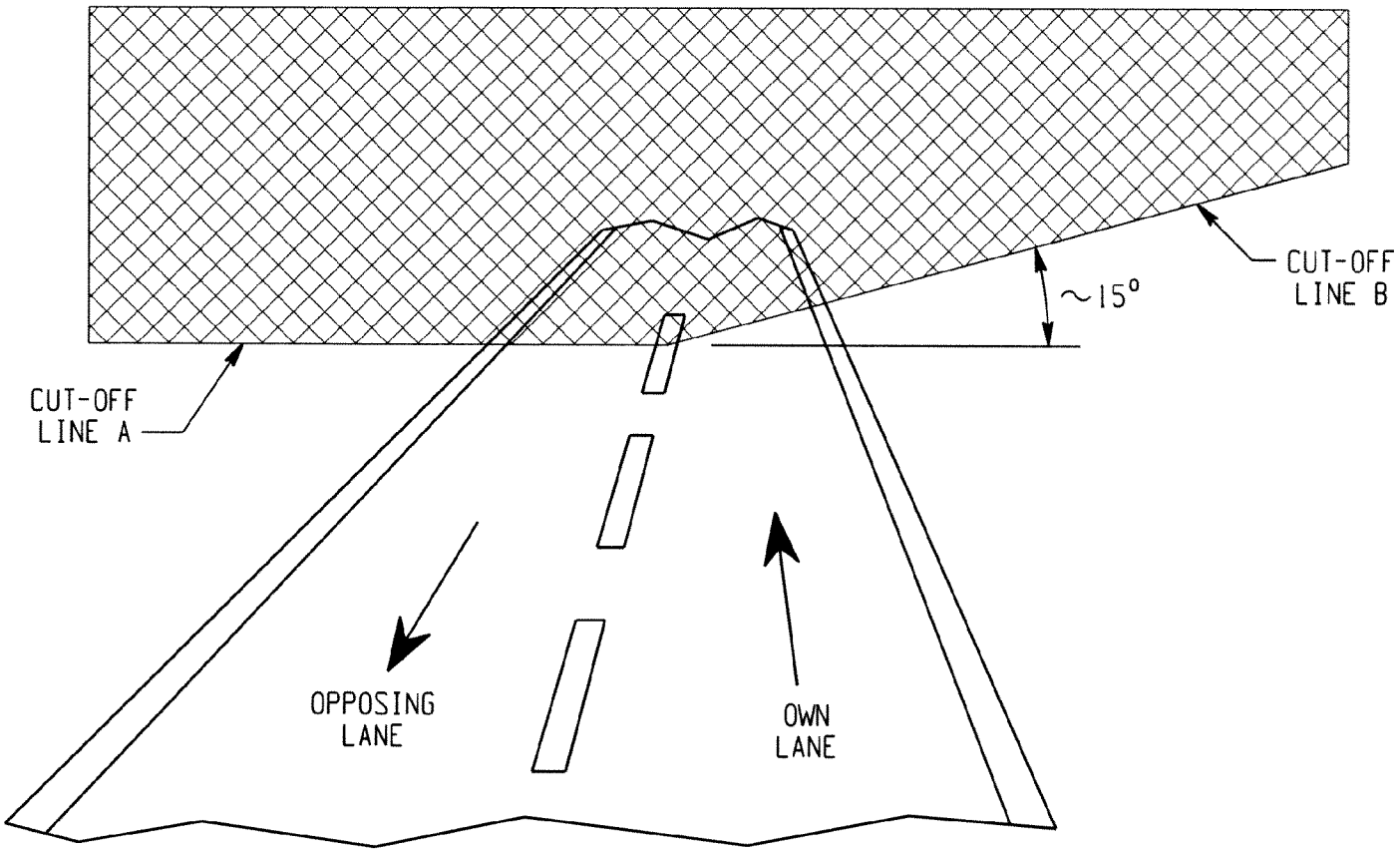
FIG. 1 is a perspective view of a roadway showing the desired region of illumination in the oncoming lane with a horizontal cut-off line A and the permitted illumination in the travelling lane with a 15° cut-off line B.
Figure 2:
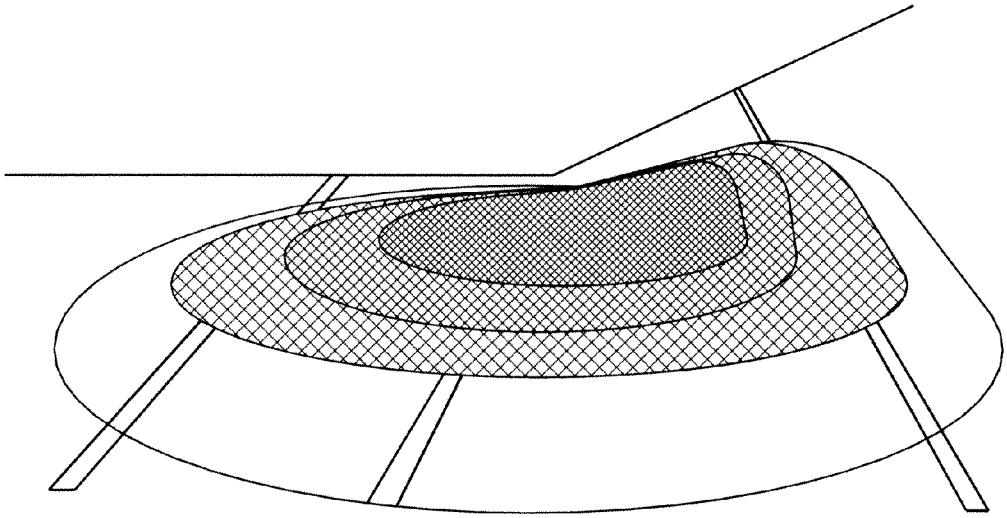
FIG. 2 is a perspective view of the distribution of illumination on the road surface in "low beam" mode of illumination.
Figure 3:
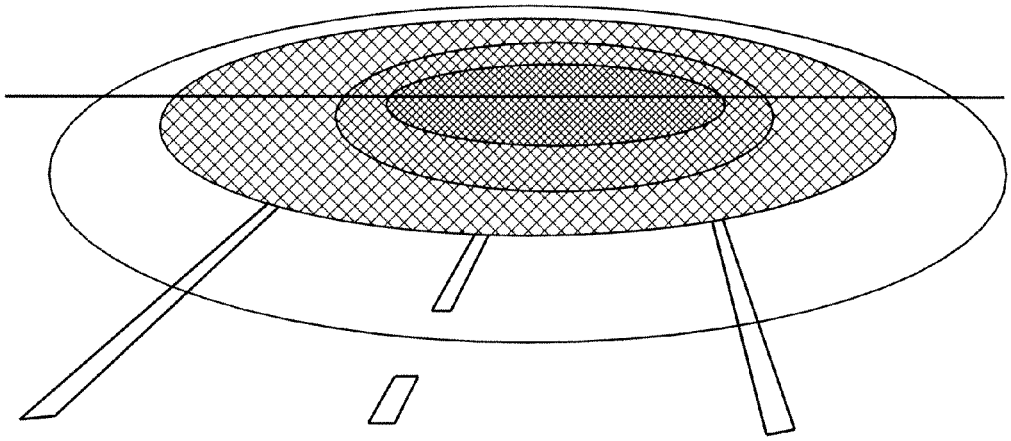
FIG. 3 is a view similar to FIG. 2 showing the illumination distribution on the road surface in "high beam" mode of headlamp operation.
Figure 4:
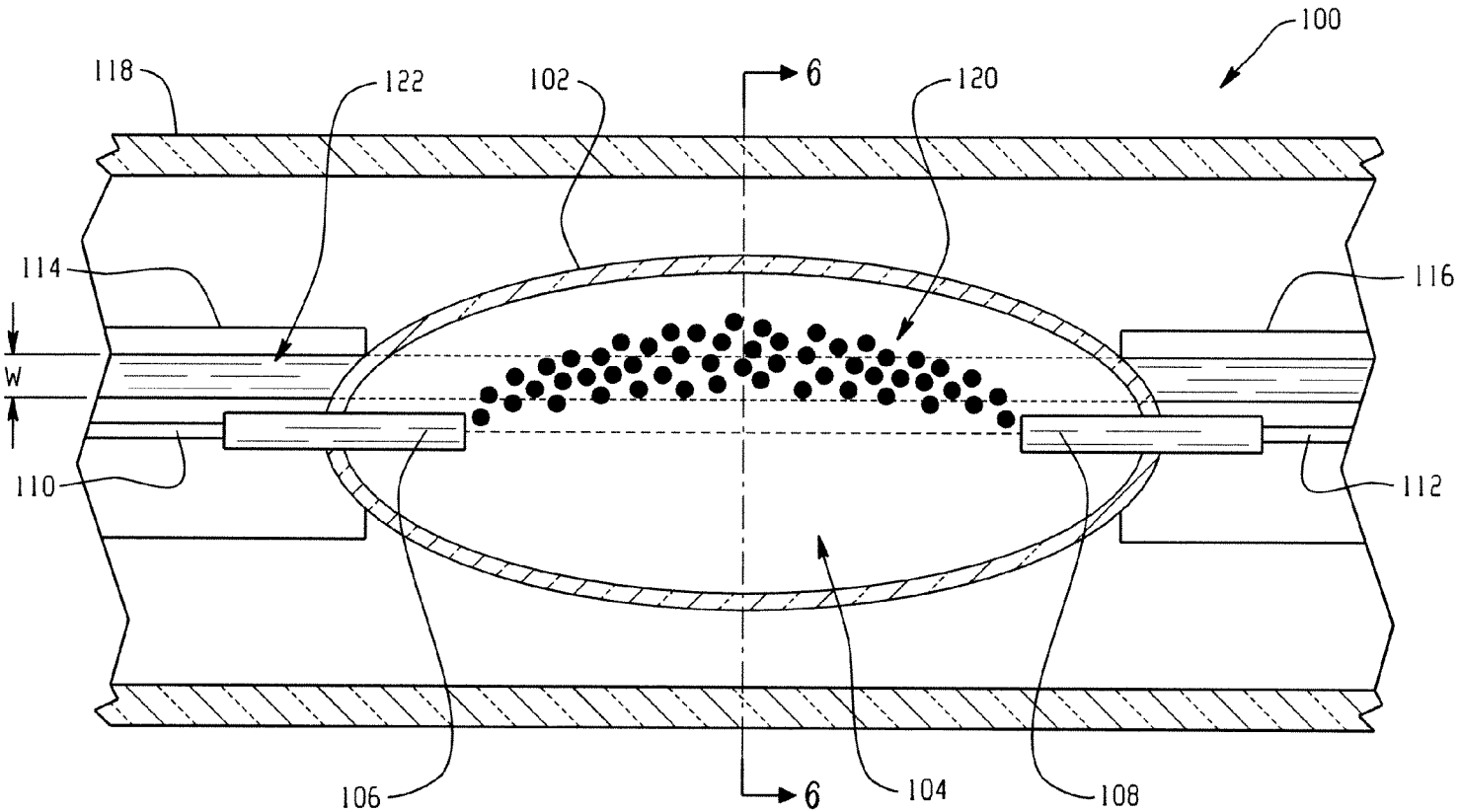
FIG. 4 is a longitudinal cross-section of a mercury-free high intensity discharge lamp with a textured light scattering stripe on the interior surface of the outer envelope according to the present disclosure.
Figure 5:
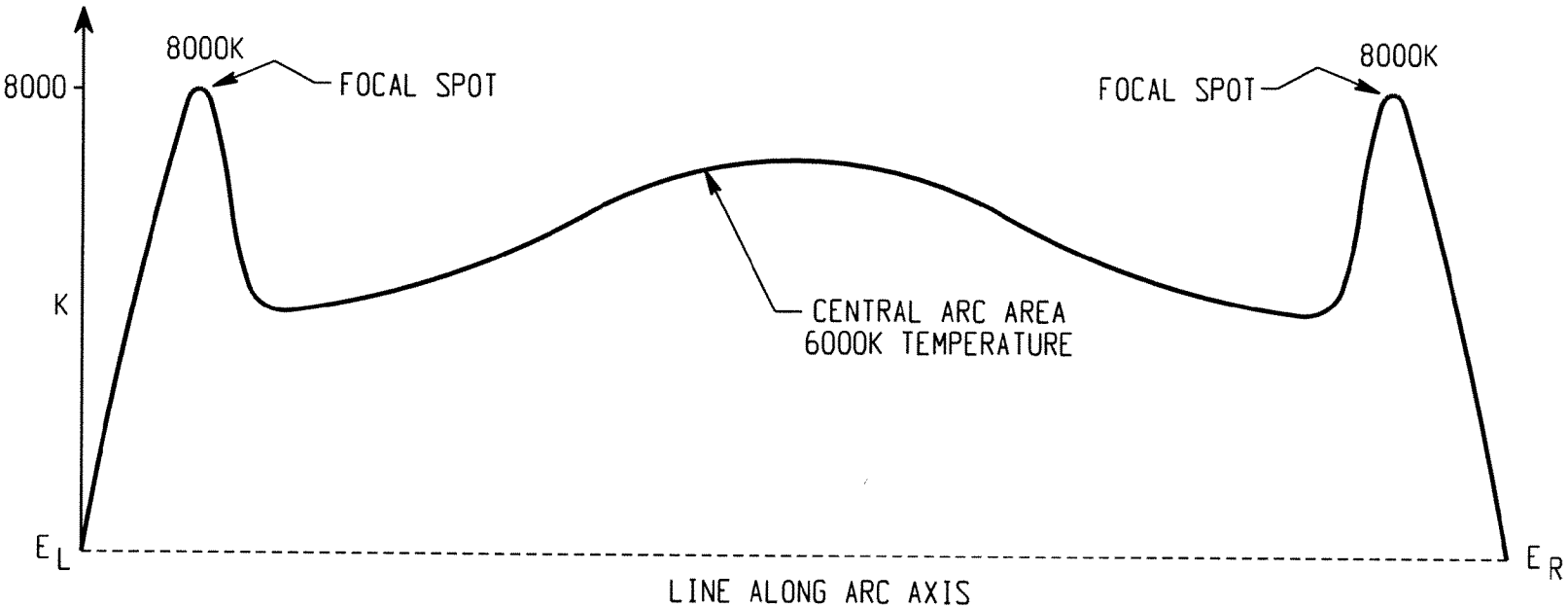
FIG. 5 is a graph of the arc discharge centerline temperature distribution as a function of arc length along the arc axis of a mercury-free high intensity discharge lamp according to the present disclosure.

Referring to FIG. 4, one version of the mercury-free high intensity discharge (HID) lamp of the present disclosure is indicated generally at 100 and includes a transparent enclosure 102 forming an arc discharge chamber 104 which has disposed at opposite ends thereof, extending outwardly through the wall thereof in sealed arrangement, a left-hand electrode 106 and spaced therefrom and oppositely disposed a corresponding right-hand electrode 108. The electrodes 106, 108 each have an electrical lead respectively 110, 112 attached thereto for connection to a source of electrical potential (not shown). Electrical lead 110, 112 generally comprise multiple components that constitute a vacuum-tight seal portion 114, 116 at the arc tube ends, the structure of which withstands all of the thermo-mechanical stresses induced by the mismatch of thermal expansion coefficients of the arc chamber material and components of electrical leads 110 and 112. The enclosure 102 and tubes 114, 116, which constitute the discharge vessel of the mercury-free arc discharge lamp, are disposed within an outer transparent envelope or tube 118. Enclosure 102 is filled and sealed with ionizable materials such as a noble gas, a suitable material for replacing mercury, and other filling ingredients required to provide the desired electrical and optical characteristics of the lamp, in a manner known in the art.

Upon energization of the mercury-free high intensity discharge lamp, an arc is formed between the electrodes 106, 108 and is indicated generally at 120 with dark shading in FIG. 4 as having a generally curved configuration as seen along the distance between the electrodes 106, 108.

A textured first stripe indicated generally at 122 is formed along the interior surface of the envelope 118 and has a width noted by the reference character "W" and has a textured configuration extending longitudinally continuously and substantially in parallel with the arc discharge running between the two opposing electrodes 106, 108.

Figure 6:
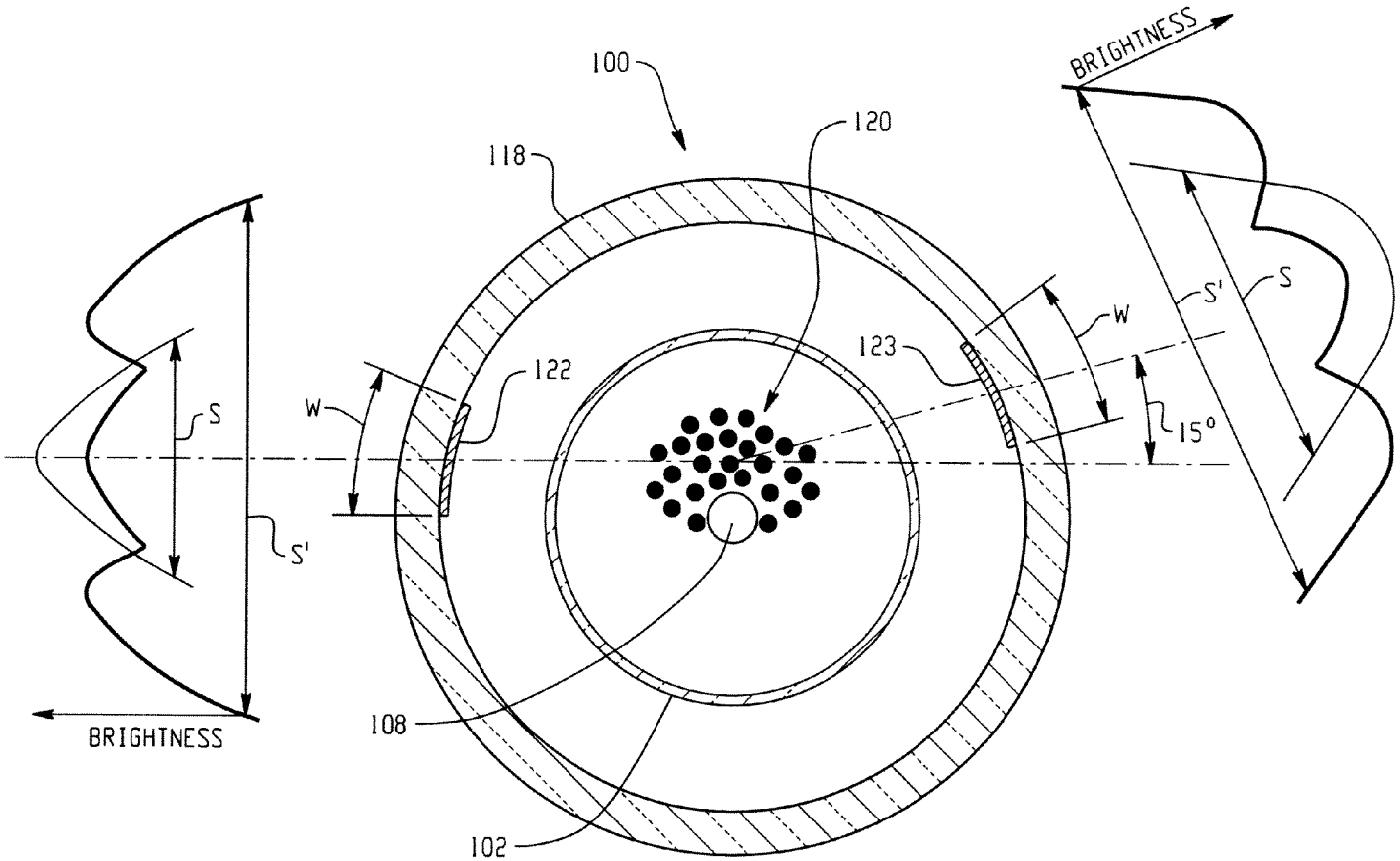
FIG. 6 is a section view taken along section indicating line 6-6 of FIG. 4; and, FIG. 7 is a view similar to FIG. 6 of another version of the mercury-free high intensity discharge lamp of the present disclosure representing the embodiment when each textured light scattering stripe is a plurality of stripes of smaller width.

Referring to FIG. 6, the textured light scattering stripe 122 is shown disposed along a horizontal line passing through the section of the envelope 118 with a second stripe 123 of similar configuration and texture disposed along the substantially opposite side of the envelope 118; however, stripe 123 is located raised from the horizontal direction by an amount of about 15°. In the present practice it has been found satisfactory to form the textured stripe as a randomly roughened surface or by regular optical grid-like structure. The stripes 122, 123 have a width W in the range of about 0.5 to 15% of the maximum transverse dimension of the outer envelope 118; and, provide for producing a width S' of the discharge arc image defined as the distance between points of 20% peak luminance of the cross-sectional luminance distribution function of the arc discharge image to fall in the range of about 0.7 to 1.5 mm. In the present practice, the stripes 122, 123 keep the degree of light scattering under control so that the peak luminance of the cross-sectional arc discharge image is caused to be not less than about 30 candela/mm$^2$ in one version and not less than 50 candela/mm$^2$ in another version. The light scattering losses caused by the stripes 122, 123 are limited to be less than about 5% and preferably less than about 3%.

Referring to the left-hand view of FIG. 6, a graphical presentation is illustrated of the luminance distribution of the arc discharge image through the textured stripe 122. Two plots are presented, the thinner line illustrates the luminance distribution of an arc image without the stripe 122 where the distance "S" indicates the width of the points of 20% peak luminance of the cross-sectional luminance distribution function of the arc discharge image; and the bolder line plot distance S' indicates the corresponding distance S' between points of 20% peak luminance points of the arc image with the stripe 122. These two plots graphically illustrate the reduction of the luminance in the central portion of the arc discharge image and the raising of luminance and broadening of luminance distribution in the regions laterally adjacent thereto.

Referring to the right-hand graphical presentation in FIG. 6, a similar presentation is shown of the luminance distribution of width S between points of the 20% peak luminance of the cross-sectional luminance distribution function of the arc discharge image for an arc discharge image without the stripe 123; and, as denoted by distribution of a width S' for an arc image formed by the presence of the stripe 123.

Figure 7:
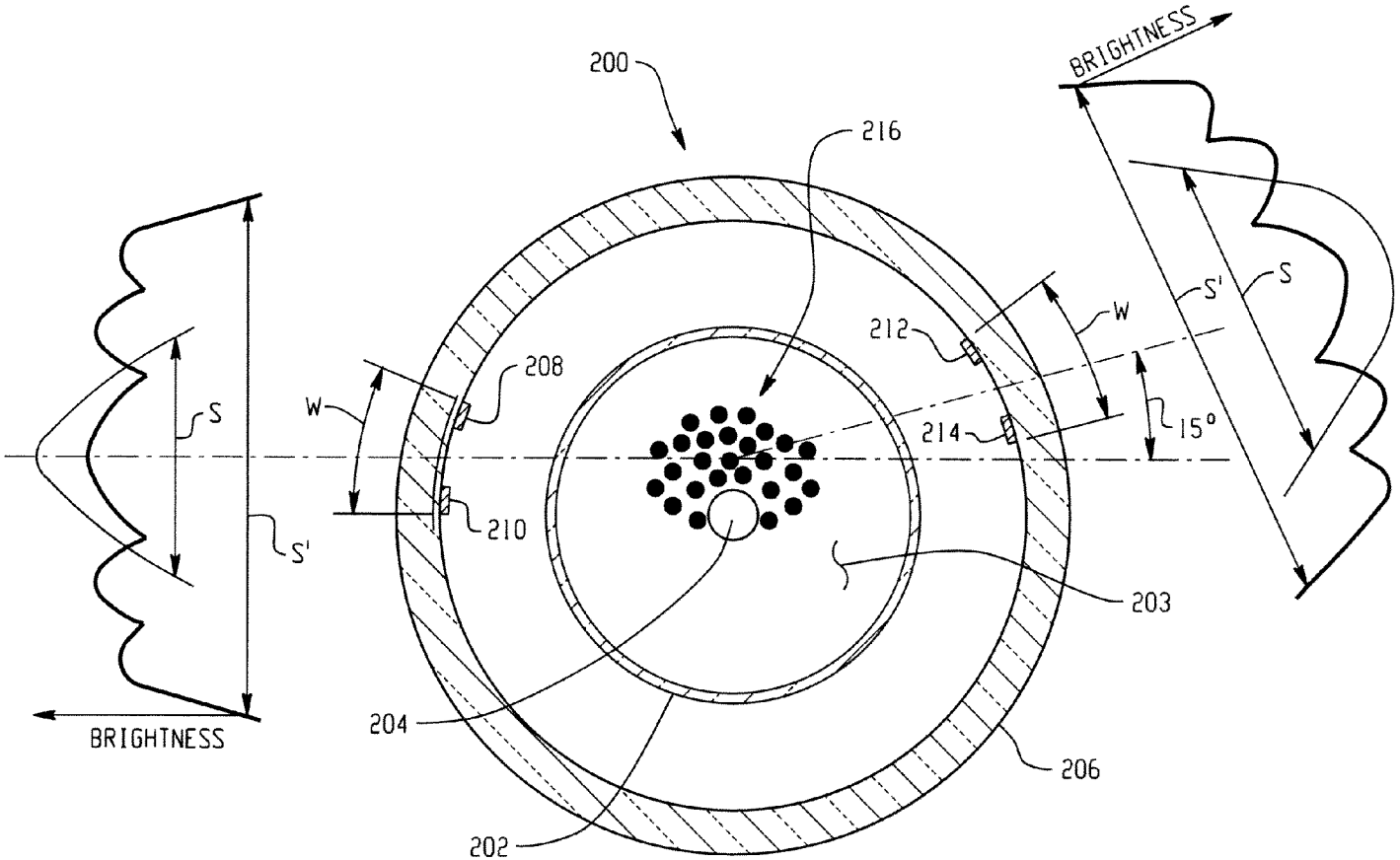

Referring to FIG. 7, another embodiment of the mercury-free HID lamp of the present disclosure is indicated generally at 200 having an arc discharge chamber 203 formed by transparent sealed enclosure 202 and charged with ionizable material with a pair of spaced opposing electrodes one of which is shown at as 204 disposed therein and surrounded by an outer transparent envelope 206. The outer envelope 206 has a pair of textured stripes 208, 210 of combined width W formed on one side of the inner surface thereof and extending axially along the length of the envelope for at least a distance including the distance of the electrodes such as electrode 204. A similar set of stripes 212, 214 are provided on the opposite side of the envelope 206 on the interior surface thereof having a combined width W. The set of stripes 212, 214 are located on substantially opposite side on the circumference of the outer envelope 206 but are offset by about 15 degrees (15°) from the exactly opposing 180 degrees (180°) direction. The combined width W and the light scattering properties of the stripes of version 200 of FIG. 7 are similar to those of the version 100 of FIG. 6. Referring to the left-hand and the right-hand graphical presentations of FIG. 7, it is seen from the dual graphical presentations in each side view that the stripes 208, 210 and 212, 214 provide similar broadening of the arc discharge image as denoted by the width S' as the distance between points of 20% peak luminance of the cross-sectional luminance distribution function and width S' is substantially wider than the similar distribution of width S for a high intensity discharge lamp without the stripes 208, 210 and 212, 214.

The mercury-free high intensity gas discharge lamp of the present disclosure thus provides an arc discharge image having a slightly reduced central peak luminance but with a considerably wider and more evenly distributed cross-sectional luminance distribution resulting from light scattering by the at least one textured stripe provided on the interior of the outer envelope. In addition, because the textured stripe extends continuously from one electrode to the opposite electrode and in parallel with the arc discharge, it provides a straighter arc image as well as reduced intensity of the "focal spots" or high temperature regions of the arc adjacent the electrodes. The mercury-free high intensity gas discharge lamp of the present disclosure thus provides a simple and low-cost technique for improving the spatial arc luminance distribution of the lamp rendering it particularly suitable for automotive headlamp installations where specifically defined beams must be generated by lenses or reflectors for controlling the area and intensity of illumination on the road surface.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A mercury-free high intensity gas discharge lamp comprising:

(a) a discharge vessel with a pair of spaced and opposing electrodes disposed therein and defining a discharge chamber;

(b) an ionizable fill material charged in the discharge vessel;

(c) an outer envelope disposed about the discharge vessel, the outer envelope having at least one light scattering stripe formed on the inner surface of the outer envelope, extending generally in parallel to the arc discharge developed between the two opposing electrodes of the discharge vessel in an energized state of the lamp and continuously from the region of one electrode to the region of the other electrode of the pair and having a width in the range of about 0.5 to 15% of the maximum transverse dimension of the outer envelope.

2. The lamp defined in claim 1, wherein the at least one light scattering stripe modifies the cross-sectional luminance distribution of the arc discharge image to have a width S, defined as the distance between 20% points of peak luminance of the cross-sectional luminance distribution function of the arc discharge image, in the range of about 0.7 to 1.5 mm.

3. The lamp defined in claim 1, wherein degree of light scattering by the at least one light scattering stripe is controlled such that the peak luminance of the cross-sectional arc discharge image is caused to be not less than about 30 Mega candela/$m^2$.

4. The lamp defined in claim 1, wherein degree of light scattering by the at least one light scattering stripe is controlled, such that the peak luminance of the cross-sectional arc discharge image is caused to be not less than about 50 Mega candela/$m^2$.

5. The lamp defined in claim 1, wherein the light scattering losses by the at least one light scattering stripe are limited to be less than about five percent (5%).

6. The lamp defined in claim 1, wherein the light scattering losses by the at least one light scattering stripe are limited to be less than about three percent (3%).

7. The lamp defined in claim 1, wherein the extent of bending of the arc discharge image measured at substantially half-way between the two opposing electrodes in the discharge chamber is decreased by an amount in the range of about 10 to 30% as compared to the bending of the arc image in a lamp without the at least one light scattering stripe on the outer envelope.

8. The lamp defined in claim 1, wherein the at least one light scattering stripe comprises a plurality of light scattering stripes.

9. A mercury-free high intensity gas discharge lamp for an automotive headlamp comprising:

(a) a discharge vessel with a pair of spaced and opposing electrodes disposed therein and defining a discharge chamber;

(b) an ionizable fill material charged in the discharge vessel;

(c) an outer envelope disposed about the discharge vessel, the outer envelope having a first and second light scattering stripe each formed on the inner surface of the outer envelope, extending generally in parallel to the arc discharge developed between the two opposing electrodes of the discharge vessel in an energized state of the lamp and continuously from the region of one electrode to the region of the other electrode of the pair wherein the first and second stripes are disposed on substantially opposite sides on the circumference of the outer envelope.

10. The discharge lamp defined in claim 9, wherein the one of the first and second light scattering stripe disposed on substantially opposite sides on the circumference of the outer envelope are offset from the other by an amount subtending a central angle measured at the geometrical center point of the substantially circular cross-section of the generally tubular outer envelope by about 15 degrees (15°) from the opposing 180 degrees (180°) direction.

11. The discharge lamp defined in claim 9, wherein the first and second light scattering stripes have a width of about 0.5 to 15 percent (%) of the maximum transverse dimension of the outer envelope.

12. The discharge lamp defined in claim 9, wherein the first and second light scattering stripes each comprise a plurality of light scattering stripes of reduced widths.

13. A method of diffusing and straightening the arc discharge image in a mercury-free high intensity gas discharge lamp comprising:

(a) providing a discharge vessel and forming a discharge chamber therein charged with an ionizable fill material and disposing a pair of spaced and opposing electrodes therein;

(b) disposing an outer envelope about the discharge vessel; and, (c) forming at least one light scattering stripe on the inner surface of the outer envelope and orienting the at least one stripe generally in parallel to the arc discharge developed between the two opposing electrodes of the discharge vessel in an energized state of the lamp and configuring the at least one stripe to extend continuously from the region of one electrode to the region of the other electrode of the pair and to have a width of about 0.5 to 15% of the maximum transverse dimension of the outer envelope.

14. The method defined in claim 13, wherein the step of forming the at least one light scattering stripe includes modifying the cross-sectional luminance distribution of the arc discharge image to have a width S (defined as the distance between 20% points of peak luminance of the cross-sectional luminance distribution function of the arc discharge image) in the range of about 0.7 to 1.5 mm.

15. The method defined in claim 13 wherein the step of forming the at least one light scattering stripe includes configuring the texture of the at least one stripe for controlling the degree of light scattering so that the peak luminance of the cross-sectional arc discharge image is caused to be not less than about 30 Mega candela/$m^2$.

16. The method defined in claim 13, wherein the step of forming the at least one light scattering stripe includes configuring the texture of the at least one stripe for controlling the degree of light scattering so that the peak luminance of the cross-sectional arc discharge image is caused to be not less than about 50 Mega candela/$m^2$.

17. The method defined in claim 13 wherein the step of forming the at least one light scattering stripe includes configuring the texture of the at least one stripe for limiting the light scattering losses to be less than about five percent (5%).

18. The method defined in claim 13, wherein the step of forming the at least one light scattering stripe includes configuring the texture of the at least one stripe for limiting the light scattering losses to be less than about three percent (3%).

19. The method defined in claim 13 wherein the step of forming the at least one light scattering stripe includes configuring the texture of the at least one stripe for decreasing the extent of bending of the arc discharge image measured at substantially half-way between the two opposing electrodes in the discharge chamber by an amount in the range of about 10 to 30% as compared to the bending of the arc image in a lamp without the at least one light scattering stripe on the outer envelope.

20. The method defined in claim 13 wherein the step of forming the at least one light scattering stripe includes forming a plurality of light scattering stripes constituting the at least one stripe as a set of stripes of reduced widths.

* * * * *